United States Patent [19]

Marin

[11] 3,945,635

[45] Mar. 23, 1976

[54] POWER STACKER

[75] Inventor: Mario J. Marin, South Norwalk, Conn.

[73] Assignee: Pitney-Bowes, Inc., Stamford, Conn.

[22] Filed: July 19, 1974

[21] Appl. No.: 490,197

[52] U.S. Cl. ..... 271/202; 271/216; 271/69

[51] Int. Cl.[2] ..... B65H 29/66

[58] Field of Search ..... 271/2, 69, 198, 199, 200, 271/202, 203, 213, 216, 270, 258, 264, 64, 155

[56] References Cited

UNITED STATES PATENTS

| | | | |
|---|---|---|---|
| 2,233,151 | 2/1941 | Welk | 271/216 |
| 3,321,202 | 5/1967 | Martin | 271/198 |
| 3,336,028 | 8/1967 | Schonmeier | 271/202 |
| 3,378,254 | 4/1968 | Eichorn | 271/155 |
| 3,527,460 | 9/1970 | Lopez | 271/69 |
| 3,542,362 | 11/1970 | Brockmuller et al. | 271/202 |
| 3,565,423 | 2/1971 | Kluth | 271/199 |
| 3,700,232 | 10/1972 | Wiegert et al. | 271/216 |
| 3,752,043 | 8/1973 | Rapparlie et al. | 271/202 |
| 3,776,544 | 12/1973 | Watson et al. | 271/198 |

*Primary Examiner*—Evon C. Blunk
*Assistant Examiner*—Robert Saifer
*Attorney, Agent, or Firm*—William D. Soltow, Jr.; Albert W. Scribner; Martin D. Wittstein

[57] ABSTRACT

A stand-alone power stacker for envelopes and similar type planar articles is provided wherein two end to end arcuately adjustable belt conveyors are adapted to be driven at automatically varying relative speeds depending on load conditions. The machine drive motor is controlled by a sensing means that detects the presence of each envelope that is delivered to the upstream end of the stacker and a time delay control circuit is provided to delay a termination of operation of said motor for a selected time period after said sensing means has completed a sensing operation. The arcuate adjustability of the outer ends of said conveyors permits the upstream one of said conveyors to receive envelopes, etc. from various heights and the downstream one of said conveyors to generate envelope stacks of desired compactness or density.

23 Claims, 11 Drawing Figures

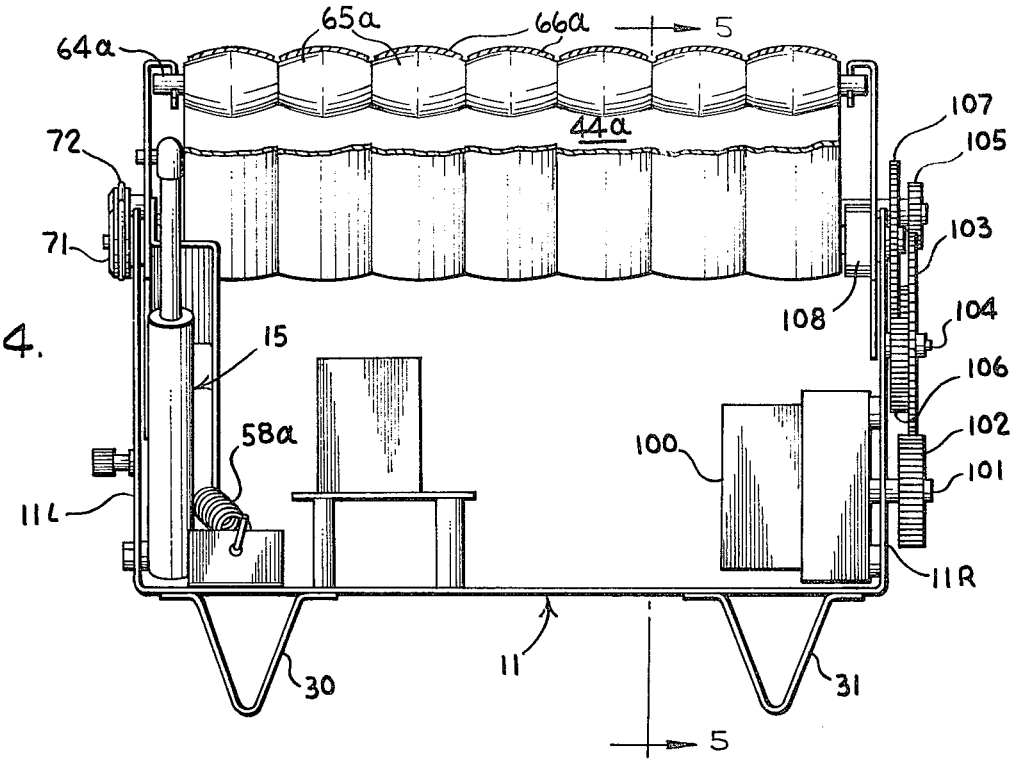
Fig. 4.
Fig. 5.
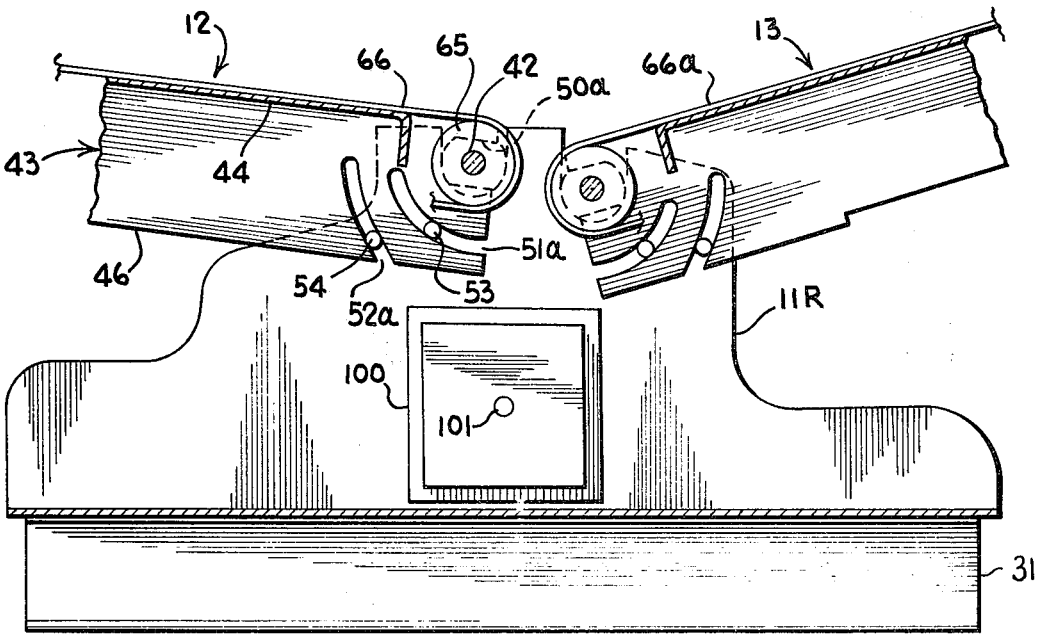

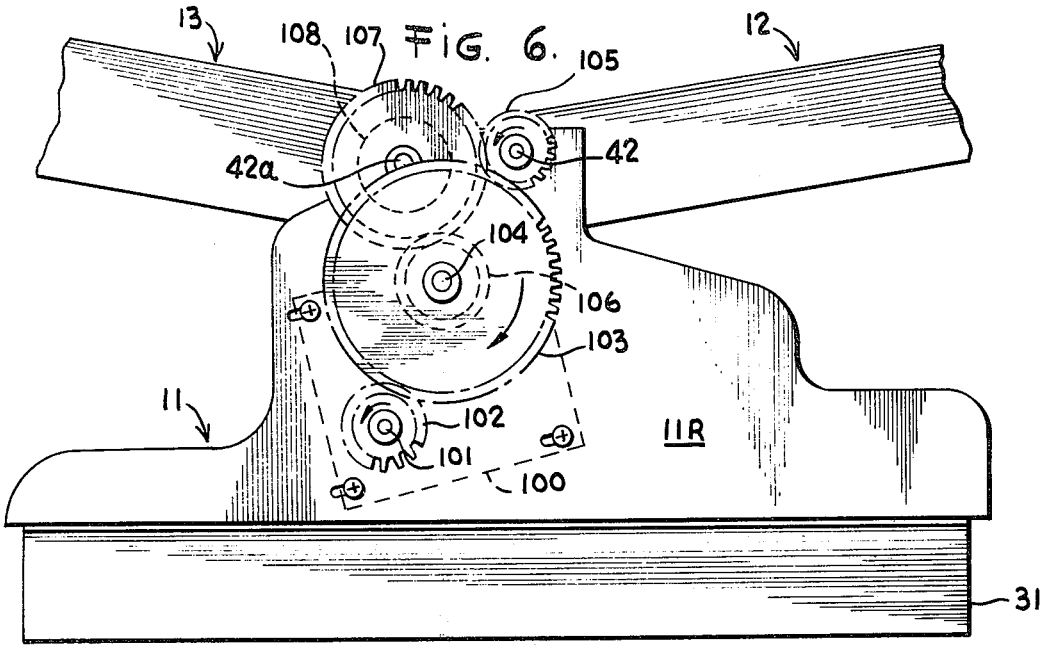
Fig. 6.
Fig. 7.
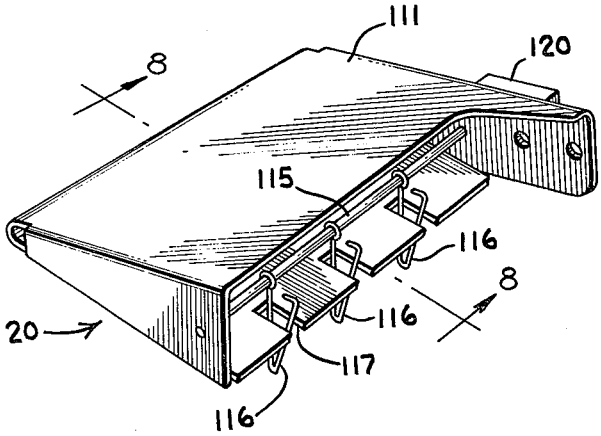
Fig. 9.
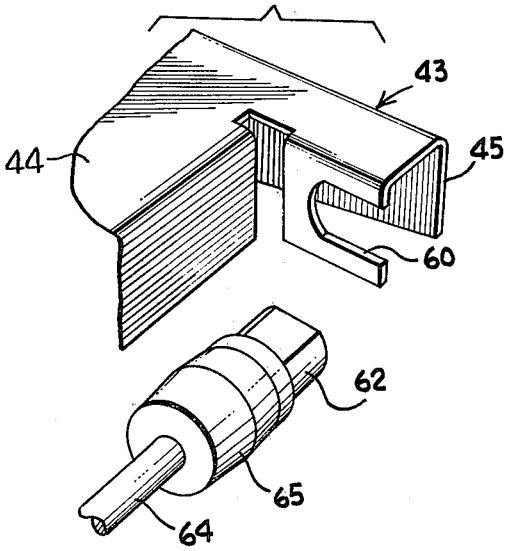
Fig. 8.
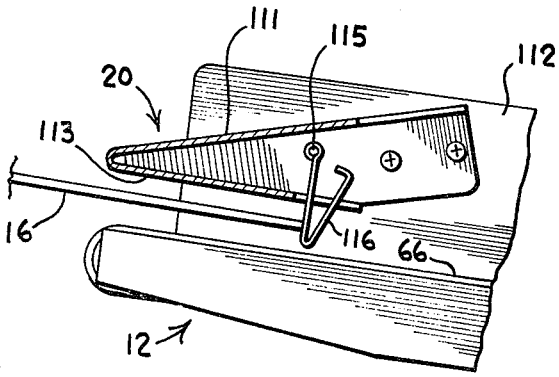

FIG. 10.
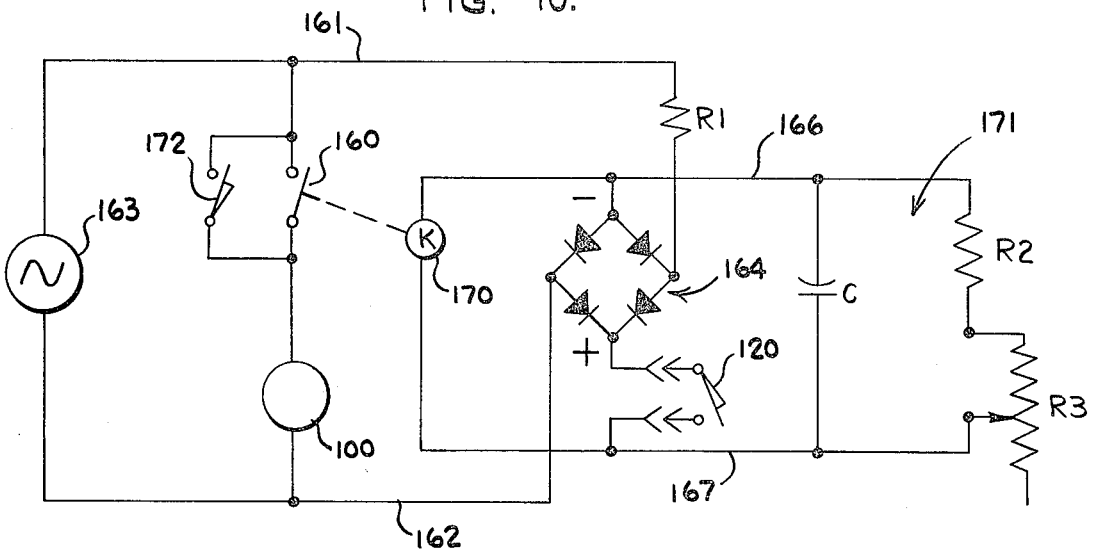
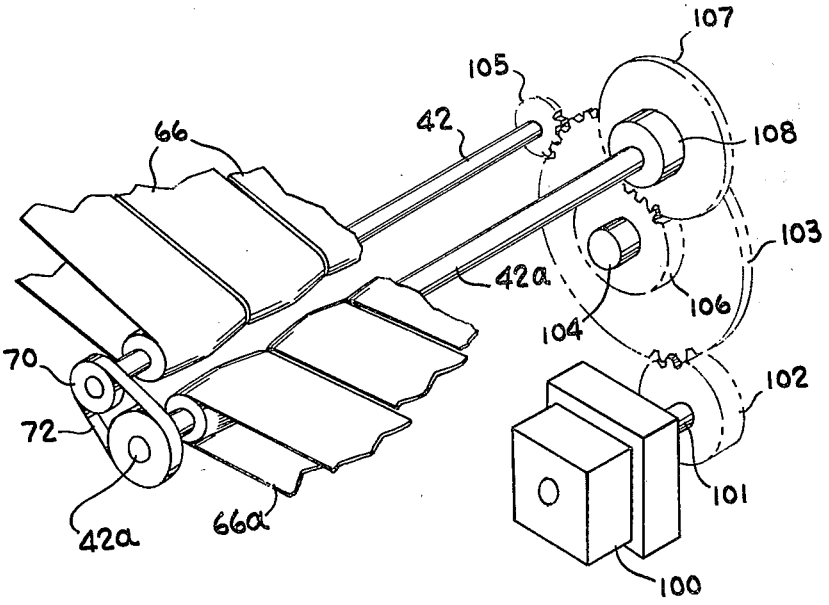
FIG. 11

POWER STACKER

This invention relates to an improved power-operated stacker for sheet material such as cards, envelopes, letters and the like. More specifically the invention relates to a novel low-cost stand-alone power stacker for planar articles wherein a conveyor means is adapted to be variably conditioned and controlled so as to accommodate a wide range of operational parameters.

BACKGROUND OF THE INVENTION

There are many applications where a plurality of sheets or planar type articles such as envelopes are to be conveyed to a stacking station and stored therein in inclined overlapped relation. In this type of operation there are three different types of variables that must be accommodated by the sheet conveying and stacking device if the latter is to have a wide range of application. First if the device is to be a stand-alone unit, its upstream end must be operationally adjustable to the extent necessary to cooperate with an adjacent upstream machine such as a postage meter, addressing machine, folding machine, etc. Secondly the device must be structurally and functionally capable of handling a wide range of sizes, shapes, weights, etc. of said planar type articles; and thirdly the device must be operationally flexible enough to allow the density and disposition of the stacked articles to be varied as desired or as required under many different sets of operating circumstances.

The known sheet stacking machines have for the most part fallen short of being able to accommodate all these variables and have tended to be relatively expensive and cumbersome.

SUMMARY OF THE INVENTION

The present invention contemplates a simple, inexpensive power stacking device that includes two serially arranged conveyor means; the first conveyor means serving to transport the articles in predetermined overlapped relation to the second conveyor means where the articles are further compacted, stacked and positioned in a selectable manner. The upstream end of the first conveyor means is independently swingably adjustable to accommodate the height of the upstream machine that is to deliver articles to the first conveyor means, while the downstream end of the second conveyor means is independently swingably adjustable to different inclined positions so as to control the density and position of the article stack being generated. Operation of the drive means for the two conveyor means is initiated by actuation of an article sensing switch associated with the first conveyor means and is terminated at a predetermined time after completion of a sensing operation of said sensing means. Said drive means is also arranged so as to enable the speed of the second conveyor means to vary relative to the speed of the first conveyor means in accordance with the article load experienced by the second conveyor means.

A primary object of the invention is to provide an inexpensive, efficient and very flexible power stacking device for planar articles such as envelopes and the like.

Another object of the invention is to provide a novel stand-alone dual conveyor stacking device that is operationally adjustable so as to accommodate a wide range of operating variables.

A further object of the invention is to provide a novel power stacking device that is adapted to automatically generate various predetermined stacking conditions for the articles being handled.

Other objects of the invention will become apparent as the disclosure progresses.

In the drawings:

FIG. 4 is an end view taken from the right side of the device as seen in FIG. 2.

FIG. 5 is a sectional elevational view taken along section line 5—5 of FIG. 4.

FIG. 6 is a rear elevational view illustrating primarily the gear drive trains associated with the instant apparatus.

FIG. 7 is a perspective view of the article sensing means of the instant apparatus.

FIG. 8 is a sectional elevational view taken along section line 8—8 of FIG. 7.

FIG. 9 is a fragmentary exploded perspective view illustrating a shaft supporting arrangement used in the instant device.

FIG. 10 is a circuit diagram for the instant motor control means.

FIG. 11 is a perspective view illustrating the power drive trains for the two conveyors.

The apparatus will be initially described in a very general manner and in relation to the handling of envelopes or other similar pieces of mail, it being understood however that various other types of planar articles may be handled by the instant apparatus.

Figure 1:
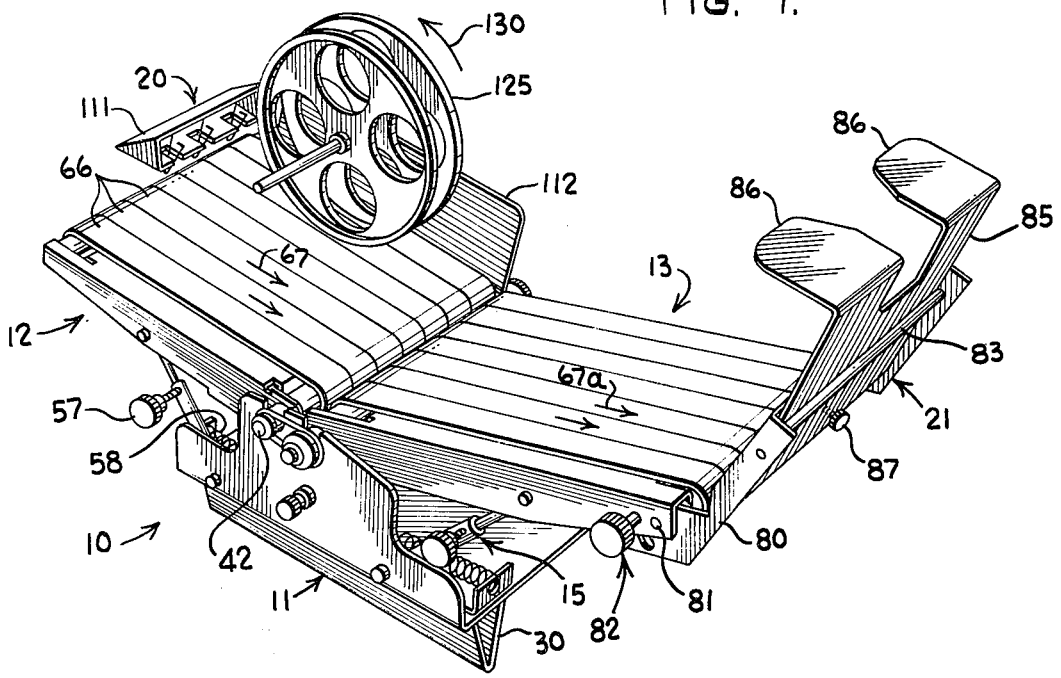
FIG. 1 is a perspective view of the instant power stacker; the covers of the machine being omitted to facilitate the showing and understanding of the operating portions of the apparatus.
Figure 2:
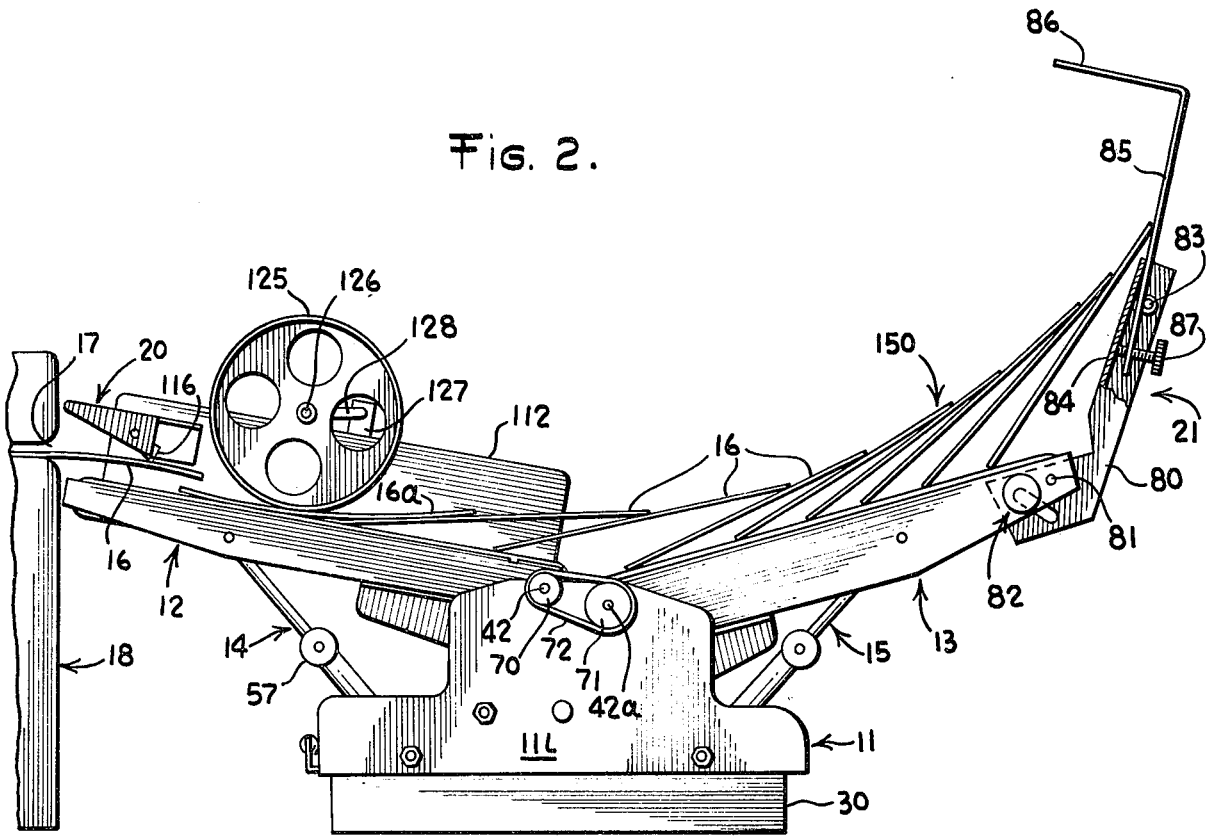
FIG. 2 is a front elevational view of the apparatus shown in FIG. 1.
Figure 3:
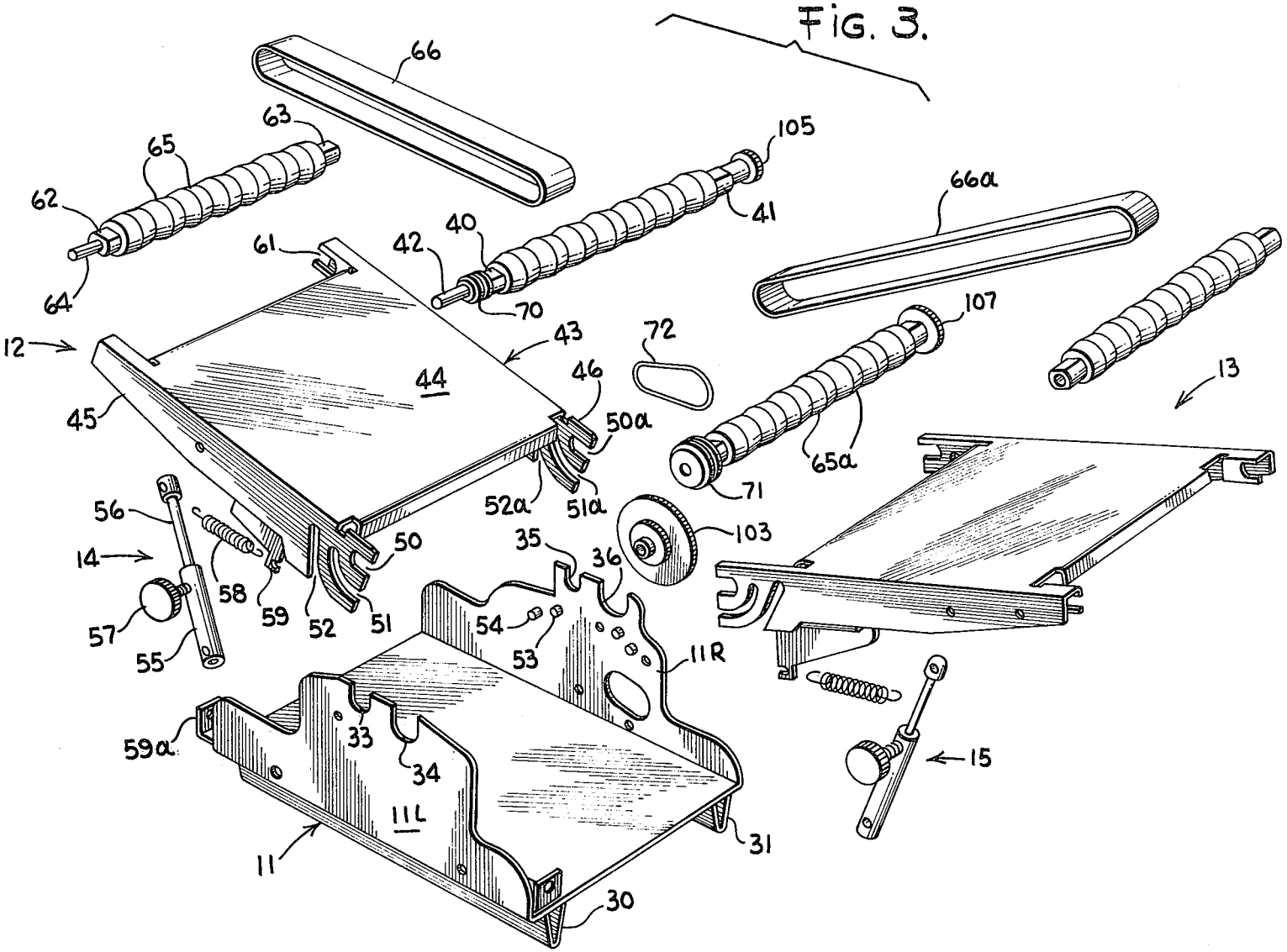
FIG. 3 is an exploded perspective view of some of the main structural portions of the instant power stacker.

Referring initially to FIGS. 1, 2 and 3 the power stacker 10 comprises generally a U-shaped base or frame 11 which carries two conveyors 12 and 13. The mutually adjacent inner ends of the conveyors are each pivotally mounted on frame 11 while the respective outer ends thereof are adapted to be fixed in selected vertical positions by means of suitable adjustable support means 14 and 15 respectively, FIG. 2. The upstream end of the first conveyor 12 is vertically positioned so as to accommodate the envelopes 16 being delivered thereto through the discharge passageway 17, FIG. 2, of the upstream addressing or other machine 18. The envelope 16 in being deposited on the conveyor 12 is adapted to operate a sensing switch means 20 carried at the said upstream end of said conveyor 12. This sensing means is adapted to control a multi-speed drive means for the conveyors 12 and 13 so as to bring the successive envelopes 16 into predetermined overlapped relation on conveyor 12 and to thereafter deliver these overlapped envelopes onto conveyor 13 where they are progressively urged toward a more steeply inclined condition at the right side of the machine as illustrated in FIG. 2. The downstream end of conveyor 13 is provided with an adjustable article abutment means 21 that is adapted to control the position, density and inclination of the developed envelope stack 150 so as to facilitate easy manual or other removal thereof from the machine.

A more detailed structural and operational description of the instant device will now be made referring first primarily to FIGS. 1–6, again with reference to the handling of envelopes. The U-shaped frame 11 is provided with suitable foot supports 30, 31, FIGS. 1, 3 and 4, and the upper ends of the two vertical side portions 11L and 11R of said frame are each formed with a pair of bearing receiving slots 33, 34, 35, 36 respectively, FIG. 3. Axially aligned slots 33 and 35 cooperatively form a portion of the pivotal support for the first or transport conveyor 12 while slots 34, 36 correspondingly form a portion of the pivotal support for the second conveyor 13. In that the construction and support for each of said conveyors is substantially the same, a detailed description for just conveyor 12 will suffice here. Slots 33, 35 are shaped to receive the bearing bushings 40, 41, FIG. 3; a shaft 42 being rotatably supported in said bushings. The conveyor 12 comprises a sub-frame 43 having a flat center portion 44 and two depending side flanges 45, 46. The inner end of flange 45 is formed with three slots 50, 51, 52 while flange 46 is correspondingly slotted at 50*a*, 51*a* and 52*a*. The axially aligned slots 50, 50*a*are adapted to engage the said bushings 40, 41 while slots 51*a* and 52*a* are adapted to engage studs 53, 54 fixed to frame side portion 11R respectively, and slots 51 and 52 are adapted to engage similarly shaped and located studs fixed to the inside surface of frame side portion 11L. As will be apparent the slots 50, 50*a* in combination with the bushings 40, 41 afford a pivotal support for the inner end of conveyor 12; the slots 51, 52, 51*a* and 52 and the associated studs such as 53, 54 serving to (a) initially facilitate assembling the conveyor 12 on the frame 11, note FIG. 5, and (*b*) retain the bushings 40, 41 in said slots 33, 35. The outer end of the conveyor 12 is adapted to be adjustably supported by said means 14 which includes a pair telescoping members 55, 56 that are pivotally connected by any suitable pins to the frame side portion 11L and the said flange 45 respectively. A manually operable clamp screw 57 is provided to lock the conveyor 12 in adjusted angular position. To facilitate handling of the conveyor 12 during the positional adjustment thereof, a spring 58 is anchored between a depending lug 59 fixed to the sub-frame side portion 45 and a bracket 59*a* fixed on the frame 11 so that said conveyor 12 may be yieldably biased in a clockwise direction as viewed in FIGS. 1 and 3. The spring exerts a clockwise torque on conveyor 12 that is substantially equal to the counterclockwise torque developed by the unsupported portion of the weight of said conveyor. The outer end of the conveyor sub-frame 43 is formed with slots 60 and 61, FIGS. 3 and 9, that are adapted to receive bearing bushings 62, 63, FIGS. 3 and 9, which in turn rotatably support a shaft 64. Rotatably secured to each of said shafts 42 and 64 are a plurality of barrelshaped rollers, such as are illustrated at 65 of FIGS. 3 and 9, around which are mounted a plurality of rubber-like conveyor belts 66; the belts 66 serving also to retain the bearing bushings 62, 63 in the sub-frame slots 60, 61 respectively. When shaft 42 is driven in a clockwise direction, as viewed in FIG. 1, the upper course of the various belts 66 will move in a direction indicated by arrow 67, FIG. 1.

The conveyor 13 is constructed and arranged in a manner similar to that just described for conveyor 12, and unless otherwise indicated the corresponding elements for conveyor 13 have corresponding reference numerals but carry a subscript "*a*". It will be noted from FIG. 5 particularly that the inner end of conveyor 13 is disposed slightly below the adjacent end of conveyor 12; this serving to insure an efficient transfer of envelopes from conveyor 12 to conveyor 13. The shaft 42 of conveyor 12 carries a drive pulley 70 at the end thereof while the adjacent end of the corresponding shaft 42*a* of conveyor 13 carries a slightly larger diameter pulley 71; a suitable drive belt 72, FIG. 2 being entrained around said pulleys 70, 71. Shaft 42 is thus adapted to frictionally drive belt 72 and hence the shaft 42*a* and the upper course of belts 66*a* of conveyor 13 will be driven as indicated by arrow 67*a* but at a speed that is normally slightly less than that for the said belts 66 of conveyor 12. While a belt and pulley type yieldable drive connection 70–72 has been shown and described it will be understood that any suitable yieldable drive means may be used between the shafts 42 and 42*a*.

The envelope abutment means 21 carried by conveyor 13 comprises a bracket plate 80 FIGS. 1 and 2 that is pivotally mounted at its lower end on the conveyor sub-frame by means of suitable pins such as 81. The bracket plate may be secured in any desired angular adjusted position by any suitable manually operated clamping means as indicated generally at 82 of FIGS. 1 and 2. Bracket plate 80 fixedly carries a rod 83 so that the region between said rod and the body portion 84, FIG. 2, of plate 80 is adapted to receive an abutment plate 85 that is provided with bent off ears 86 at its upper end. The lower end of plate 85 has a manually operable clamping screw 87 threaded therethrough and abutting said bracket portion 84 so that said plate may be adjustably clamped to the bracket plate 80 in various desired extended positions.

The gear drive trains for conveyors 12 and 13 will now be described with particular reference to FIG. 4, 6 and 11. An electric motor 100 mounted on frame 11 has an output shaft 101 that extends through a suitable aperture formed in the frame side portion 11R. A gear 102 secured to shaft 101 meshes with a large diameter gear 103 that is rotatably mounted on a suitable stub shaft 104 fixed to the outside of frame side portion 11R. Gear 103 meshes with a gear 105 secured to the adjacent end of shaft 42 of the first conveyor 12. Said gear 103 is formed with an integral coaxial gear 106 which meshes with a gear 107 that is coupled to the adjacent end of shaft 42*a* of the conveyor 13 through a one-way or overrunning clutch 108. As will be seen the shaft 42*a* of conveyor 13 may be rotatably driven by two different drive means, one constituted by the higher speed yieldable drive through the said friction belt 72 and the other constituted by the slower positive drive through gears 103, 106, 107 and the said positive one-way clutch 108. When the motor 100 is operated the two conveyors will be driven with the belts 66 of conveyor 12 moving slightly faster than the belts 66*a*of conveyor 13 which is then powered through the said yieldable driven 70–72. Under these conditions the clutch 108 will be overrunning and the drive for both conveyors will be through gears 103 and 105. When, however, under conditions to be described below, the load on conveyor 13 increases to the point where slippage of the belt connection 70–72 begins to occur, the speed of the belts 66*a* of conveyor 13 will begin to decrease from a normal maximum. If the slippage continues to increase the overrunning action of the clutch 108 gradually decreases and finally ceases at which time a positive drive through said clutch will occur and no further decrease in the speed of belts 66*a* will take place. This lower speed positive drive for conveyor 13 and the said slippage in the yieldable belt drive 70–72 will continue as long as the load imposed on conveyor remains above a predetermined upper level and as and when this load decreases the positive drive action through clutch 108 will cease and the conveyor 13 will be operated at gradually increasing speeds as less slippage occurs in the belt connection 70–72 until a predetermined lower level for said load is reached wherein said slippage is reduced to zero and the speed of conveyor belts 66*a* are again up to their normal maximum. This drive arrangement thus affords an automatic load responsive speed changing means for the second conveyor 13.

Referring now particularly to FIGS. 1, 2, 7 and 8 the article sensing means 20 for the present stacker includes a housing 111 that is secured to an upstanding plate 112 that in turn is fixed by any suitable means to the side 46 of the sub-frame 43, FIG. 3, of conveyor 12. As is best seen in FIGS. 7 and 8 the housing 111 at the upstream end of conveyor 12 has a generally wedge-shaped configuration and has a lower envelope guide surface 113. If desired the said housing 111 may be adjustably mounted with respect to sub-frame 43. Pivotally mounted in the side portions of housing 111 is a small diameter rod 115 having a plurality of light wire envelope sensing fingers 116 secured thereto and depending therefrom so as to respectively extend through suitable housing notches, such as 117, and into the gap between said belts 66 and said guide surface 113; this gap effectively defining a portion of the envelope feed path through the instant stacking device. The pivotal movement of rod 115 is adapted to operate any suitable conventional type electrical switch 120, FIG. 7, mounted on the side of plate 112. As may be seen from FIGS. 2 and 8, the sensing fingers 116 are adapted to be swingably displaced by the lead edge of each envelope 16 that is delivered to the conveyor 12 by the associated addressing machine, postage meter or other upstream machine 18, FIG. 2. This displacement of sensing fingers 116 and the resultant operation of switch 120 will initiate operation of the said drive motor 100 as will be more fully described below.

In order that any envelopes delivered to the conveyor 12 be initially urged into engagement with the envelope feed belts 66, a relatively large diameter idler wheel 125, FIGS. 1 and 2, is provided, the latter being rotatably supported by a Z-shaped shaft means having two parallel portions, one portion 126 rotatably supporting said wheel 125 and the other portion being pivotally carried by a block 127 that is secured to said vertical side plate 112; said shaft portions being interconnected by a center crank portion 128, FIG. 2. Wheel 125 is thus supported for vertical movement as well as rotational movement, whereby the weight of the wheel 125 may rest against the envelopes thereunder so that the latter are urged into better frictional driving engagement with the conveyor belts 66. Little if any resistance is offered here by the wheel to the feed movement of the envelopes in that the wheel rotates as indicated at 130 to accommodate this feed movement.

A description of the operation of the apparatus described thus far will now be made. The motor 100 is normally not operating but is actuated in response to the operation of the envelope sensing switch means 20. As a first envelope is delivered to the conveyor 12 the lead edge thereof will displace fingers 116 so as to operate switch 120 which through the control circuit to be described causes motor 100 to be operated for a selected but relatively short period of time during which the envelope is transported beneath the wheel 125 and towards the second conveyor 13 at a first speed determined by the speed of the conveyor belts 66. The instant control circuit is arranged so that motor 100 is kept running for a short delay period after the trailing edge or other portion of said first envelope releases said switch fingers 116, and thereafter when the motor is stopped the conveyors 12 and 13 will remain idle until the next envelope is delivered to conveyor 12 and the sensing switch means is again operated. The speed of the envelopes when being transported by conveyor 12 is preferably less than that at which the upstream machine 18 delivers the envelopes to the conveyor 12 so that as said envelopes are deposited on conveyor 12 they will be positioned in mutually overlapping relation as illustrated in FIG. 2. It will be appreciated that the speed and frequency of delivery of envelopes may be great enough to cause motor 100 to run continuously, or the frequency of said letter delivery may be low enough so that motor 100 operates intermittently, this of course depending on the duration of said short delay period. In either case the overlapped letters will be progressively transported by belts 66 and deposited on the slower moving belts 66*a*of conveyor 13. The lower speed of conveyor 13 will cause relative sheaving movement between the envelopes thereon so that the envelope stack generally designated at 150 of FIG. 2, becomes more compact with the leading edges of the envelopes coming closer together as the said stack becomes more dense. As is illustrated in FIG. 2 the conveyor 13 in addition to having a slower belt movement may be inclined slightly upwardly and the abutments means 21 may be positioned in a further inclined position, these positionments tending to cause the lead envelopes in said stack 150 to be pushed nearer and nearer to a vertical orientation as the stack builds up to a larger and larger number of envelopes. It will be understood that conveyors 12 or 13 may be positioned in any desired angular positions. As the stack 150 thus gradually developes a point will be reached where the drive load on conveyor 13 will become great enough so that slippage occurs in the yieldable friction drive 70–72. When this occurs the speed of belts 66*a* will gradually decrease until the belt drive load is picked up by the slower speed positive drive action of the normally overrunning clutch 108. After a stack of envelopes has been removed from the conveyor 13 and the load on the latter is thus reduced the friction drive 70–72 will automatically re-establish the normal speed of operation of belts 66*a* of conveyor 13 so as to quickly re-establish the build up of a next stack of envelopes.

It will be seen then that by the above described operation the present invention affords an efficient, inexpensive means for receiving, transporting and automatically stacking envelopes, there being no structural coupling or control connections necessary between the instant power stacker and the upstream machine 18 that delivers envelopes to the conveyor 12. The variable inclination possible for the conveyors 12 and 13 and the adjustable setting for the abutment means 21 enables the instant apparatus to be set to effectively accommodate a wide variety of sizes, weights and shapes of articles to be stacked. If desired an envelope guide plate similar in construction and arrangement to said plate 112 may be provided along the rear side (as viewed in FIG. 1) of conveyor 13.

Referring now to FIG. 11, a description will now be made of the control means interconnecting the sensing means 20 and the motor 100. Motor 100 and the control relay contacts 160 are connected across the lines 161, 162 from a suitable electrical supply source 163. Lines 161, 162 are also connected across a conventional rectifier bridge 164 which in turn, together with the control switch 120, is connected to the output lines 166, 167. Connected in parallel across lines 166, 167 are a relay solenoid 170 and a conventional type variable RC time delay circuit 171. If desired a suitable override or jogging switch 172 may be provided for manually controlling said motor 100. In the normal state of the control circuit of FIG. 10 the sensing switch 120, FIGS. 2 and 10, is open and hence relay contacts 160 remain open. When an envelope is delivered to conveyor 12 and switch 120 is thereby closed as above described, the said RC circuit 171 will be charged and the relay contacts will be closed thus initiating operation of the motor 100. When the trailing edge or other portion of the envelope allows the sensing switch to move to an open condition, the motor 100 will keep running for a short additional time period depending on the selected time setting for the variable RC circuit 171, the operation of the latter being well understood in the art. The envelope will, during this short time period, be transported a short distance along conveyor 12 by the belts 66 before said motor and conveyors stop. When the next envelope is delivered to conveyor 12 the sensing switch 120 will again be operated and the control cycle will be repeated. The selected amount of time delay set in the delay circuit 171 will determine to a significant extent the degree of overlap of the envelopes being transported by conveyor 12. Depending on the frequency of delivery of envelopes past the sensing means 20, the conveyors 12 and 13 will be intermittently or continuously driven so as to progressively generate the stack 150 as described above in connection with FIG. 2.

The instant power stacker has been found to be very efficient and capable of being made at relatively low cost, and of operating reliably over extended periods of use.

What is claimed is:

1. A power stacking device for planar articles: comprising a frame;

first and second conveyor means mounted on said frame and arranged in end to end relation, the respective inner ends of said first and second conveyor means being articulately supported by said frame, and the respective outer ends of said first and second conveyor means being adjustably supported with respect to the frame;

drive means for operating said conveyor means, said drive means including a positive drive for the upstream conveyor means and a yieldable slower drive for the downstream conveyor;

sensing means for determining when an article is delivered to one of said conveyor means; and control means responsive to the operation of said sensing means to control said drive means.

2. Apparatus as defined by claim 1 wherein said drive means includes a means for altering the driven speed of at least one of said conveyor means in response to the load experienced by said one of said conveyor means.

3. Apparatus as defined by claim 1 wherein said control means includes a time delay means for causing the continuation of operation of said drive means for a predetermined period following termination of a sensing operation by said sensing means.

4. Apparatus as defined by claim 1 wherein said drive means includes a yieldable drive means and a positive drive means for one of said conveyor means, said yieldable drive means being adapted to normally drive said one conveyor means at a speed greater than that produced by said positive drive means.

5. Apparatus as defined by claim 4 wherein said positive drive connection includes an overruning clutch means and wherein said one conveyor means is disposed downstream from the other of said conveyor means.

6. Apparatus as defined by claim 1 wherein said drive means is adapted to drive the downstream one of said conveyor means at a slower speed than that at which the upstream conveyor means is driven.

7. Apparatus as defined by claim 1 additionally comprising an abutment bracket plate pivotally connected to the downstream end of said second conveyor means, and means to adjustably lock said plate in various angular positions relative to said second conveyor means.

8. A power stacker: comprising a frame;

at least one conveyor means mounted on said frame;

drive means for said conveyor means; and control means for controlling the operation of said drive means;

said drive means including a yieldable drive connection and a positive drive connection whereby said conveyor means may be yieldably driven at relatively high speeds by said yieldable drive connection and whereby said conveyor means may be driven by said positive drive connection when the effective speed at which said yieldable drive means drives said conveyor means drops to the effective drive speed of said positive drive connection.

9. Apparatus as defined by claim 8: additionally comprising control sensing means for said driven means; said control means being arranged so as to be operative to actuate said drive means in response to the delivery of an article to be stacked to said power stacker.

10. Apparatus as defined by claim 9 wherein said control means includes a time delay means to delay the shutoff of said drive means for a period following termination of a sensing operation by said control means.

11. Apparatus as defined by claim 9: additionally comprising an additional conveyor means mounted on said frame in end to end relation with respect to said one conveyor means, said sensing means being adapted to sense when an article is delivered to said additional conveyor means, and said driven means being adapted to drive said additional conveyor means.

12. Apparatus as defined by claim 8 wherein said conveyor means is swingably adjustably mounted in said frame.

13. A power stacker for planar articles: comprising a frame;

a first and second belt conveyor means carried by said frame in end to end relation; the mutually adjacent ends of said belt conveyor means being pivotally supported on said frame;

means for securing the respective outer ends of said belt conveyor means in selected positions relative to said frame;

drive means for operating said first and second belt conveyor means; and control means for controlling the operating of said drive means.

14. Apparatus as defined by claim 13 wherein said drive means is adapted to normally drive said first conveyor means at an effective speed that is greater than that for said second conveyor means.

15. Apparatus as defined by claim 13 wherein said two conveyor means are driven at their respective mutually adjacent inner ends by said drive means, and wherein said drive means includes two different drive connections for driving one of said conveyor means at different speeds respectively.

16. Apparatus as defined by claim 15 wherein said drive means includes an overrunning clutch and a yieldable drive connection associated with the downstream one of said conveyor means.

17. Apparatus as defined by claim 16 wherein said control means includes a switch means and a means for delaying the termination of operation of said drive means for a predetermined selected period following termination of a sensing operation by said switch means.

18. Apparatus as defined by claim 17: additionally comprising a plate bracket pivotally adjustably mounted on the end of said downstream conveyor means, and article abutment means adjustably mounted on said end plate.

19. Apparatus as defined by claim 17 wherein said switch means is adapted to be operated by an article that is delivered to the upstream end of said first conveyor means.

20. A power stacking device; comprising a frame;

conveyor means mounted on said frame, said conveyor means including two conveyors disposed in an end to end relationship;

drive means for operating said conveyor means;

control means for controlling the operation of said drive means;

said control means including switch means, the operation of said switch means serving to initiate operation of said drive means;

time delay means for enabling the continued operation of said drive means for a short period of time following the termination of operation of said switch means; and abutment means pivotally mounted on the downstream end of said conveyor means, and carrying a slidably adjustable abutment plate.

21. A power stacking device for planar articles: comprising a frame;

first and second conveyor means mounted on said frame and arranged in end to end relation, the respective inner ends of said conveyor means being articulately carried by said frame; and the respective outer ends thereof being adjustably supported with respect to said frame;

drive means for operating said conveyor means;

sensing means for determining when an article is delivered to one of said conveyor means; and control means responsive to the operation of said sensing means for controlling the operation of said drive means.

22. A power stacking device for planar articles: comprising a frame;

first and second conveyor means mounted on said frame and arranged in end to end relation;

drive means for operating said conveyor means, said drive means including a yieldable drive means and a positive drive means for one of said conveyor means, said yieldable drive means being adapted to normally drive said one conveyor means at a speed greater than that produced by said positive drive means;

sensing means for determining when an article is delivered to one of said conveyor means; and control means responsive to the operation of said sensing means for controlling the operation of said drive means.

23. A power stacking device for planar articles: comprising a frame;

first and second conveyor means mounted on said frame and arranged in end to end relation;

drive means for operating said conveyor means, said drive means including a yieldable drive means and a positive drive means for one of said conveyor means, said yieldable drive means being adapted to normally drive said one conveyor means at a speed greater than that produced by said positive drive means, said positive drive means including an overrunning clutch means and said one conveyor means being disposed downstream from the other of said conveyor means;

sensing means for determining when an article is delivered to one of said conveyor means; and control means responsive to the operation of said sensing means for controlling the operation of said drive means.

* * * * *